US005983639A

United States Patent [19]

Kral et al.

[11] Patent Number: 5,983,639

[45] Date of Patent: Nov. 16, 1999

[54] METHOD AND SYSTEM FOR STARTING UP A CONTINUOUS FLOW STEAM GENERATOR

[75] Inventors: Rudolf Kral; Joachim Franke, both of Altdorf, Germany

[73] Assignee: Siemens Aktiengesellschaft, Munich, Germany

[21] Appl. No.: 09/017,466

[22] Filed: Feb. 2, 1998

Related U.S. Application Data

[63] Continuation of application No. PCT/DE96/01343, Jul. 19, 1996.

[30] Foreign Application Priority Data

Mar. 2, 1995 [DE] Germany ..... 195 28 438

[51] Int. Cl.[6] ..... F01K 13/02

[52] U.S. Cl. ..... 60/646; 60/656; 110/101 C; 110/101 CF; 110/101 CB

[58] Field of Search ..... 60/645, 646, 656; 110/101 C, 101 CF, 101 R, 101 CB

[56] References Cited

U.S. PATENT DOCUMENTS 4,072,182 2/1978 Cheng ..... 60/645 X
5,535,687 7/1996 Khanna ..... 60/645 X
5,560,209 10/1996 Kienbock et al. ..... 60/645

FOREIGN PATENT DOCUMENTS 0 054 601 A1 6/1982 European Pat. Off. .
0 519 178 A1 12/1992 European Pat. Off. .

*Primary Examiner*—Hoang Nguyen
*Attorney, Agent, or Firm*—Herbert L. Lerner; Laurence A. Greenberg

[57] ABSTRACT

A continuous-flow steam generator includes a combustion chamber having a number of burners for a fossil fuel and a gas-tight containment wall formed from at least approximately vertically disposed evaporator tubes through which a flow passes upwards from below on the feed-water side. A method and a system for starting up the continuous-flow steam generator avoid start-up losses by setting a water level in the evaporator tubes and a ratio of the fuel stream to the feedwater stream in such a way that the water evaporates completely during passage through the evaporator tubes, so that water is no longer present at the evaporator outlet. A start-up system having a setting device for setting the water level in the evaporator and for setting the ratio of the fuel stream to the feed-water stream, is used for this purpose.

7 Claims, 1 Drawing Sheet

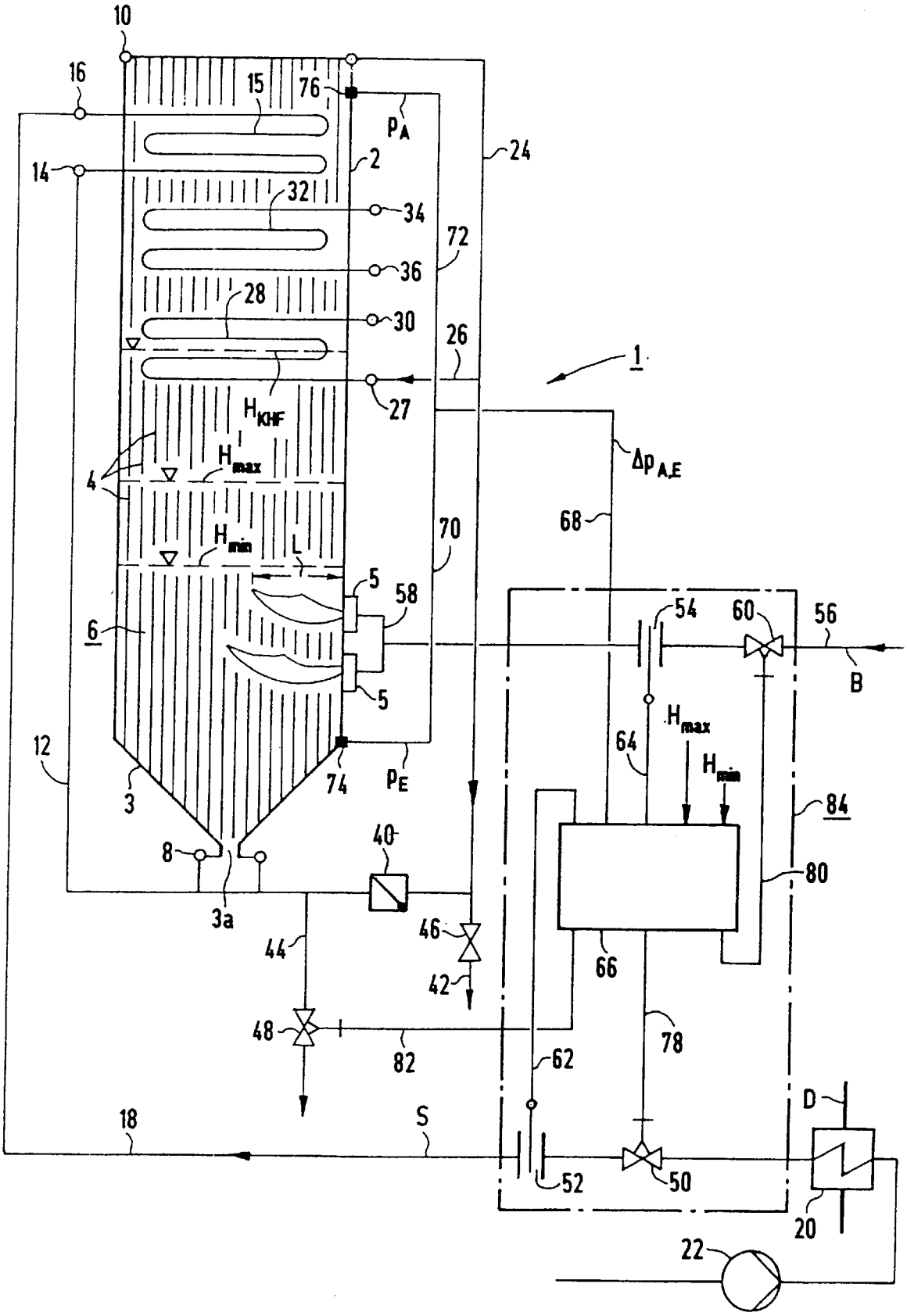
10
16
15
76
$p_A$
24
14
2
32
34
72
36
28
30
26
1
$H_{KHF}$
27
$\Delta p_{A,E}$
$H_{max}$
4
68
70
$H_{min}$
L
5
58
54
60
56
6
B
5
$H_{max}$
64
12
$H_{min}$
3
74
$p_E$
84
40
8
80
3a
46
44
66
42
48
78
82
62
D
18
S
52
50
20
22

METHOD AND SYSTEM FOR STARTING UP A CONTINUOUS FLOW STEAM GENERATOR

CROSS-REFERENCE TO RELATED APPLICATION

This application is a continuation of International Application PCT/DE96/01343, filed Jul. 19, 1996, which designated the United States.

BACKGROUND OF THE INVENTION

FIELD OF THE INVENTION

The invention relates to a method for starting up a continuous-flow steam generator including a combustion chamber having a number of burners for a fossil fuel and a gas-tight containment wall formed from at least approximately vertically disposed evaporator tubes through which a flow passes upwards from below on the feed-water side. The invention also relates to a start-up system for carrying out the method.

In a continuous-flow steam generator, the heating of vertically disposed tubes of an evaporator, which form a gas-tight containment wall of a combustion chamber, leads to a complete evaporation of a flow medium in the evaporator tubes in one pass. Conventionally, during start-up, a circulating stream is superposed on the continuous stream through the evaporator and frequently also through a preheater or an economizer disposed in the continuous-flow steam generator and is heated by flue gas. As a result, the tubes are to be reliably cooled through the use of correspondingly high velocities in the tubes. In that case, with regard to vertically disposed tubes in the containment walls of the combustion chamber, a minimum stream including the continuous stream and the superposed circulating stream is between 25% and 50% of the full-load stream. Accordingly, during start-up, the steam generator load first has to be increased to at least 25% to 50% before reaching continuous-flow operation that is advantageous in terms of efficiency, with its high steam outlet temperatures.

Therefore, as is known from Published European Patent Application 0 054 601 A1, a quantity of flow medium to be conveyed by a feed pump is conventionally preferably kept constant for the start-up and in a load range lying below a specific limit load of 50% of the full load. In that case, the conveying stream of the feed pump is equal to the evaporator throughput. In that mode of operation, the start-up times commencing with the ignition of a first burner of the continuous-flow steam generator and terminating when continuous-flow operation with its high steam temperatures is reached, are very long. That results in relatively high start-up losses since their magnitude is influenced essentially by the start-up times.

High start-up losses also arise from a water excess. That occurs, on one hand, as a result of a mass water flow which is high in comparison with the heat supplied and, on the other hand, as a result of the so-called water ejection. The latter in turn occurs when evaporation commences in the middle of the evaporator and pushes out the water quantity that is present downstream (water plug). Consequently, a continuous-flow steam generator conventionally has a separation device, out of which excess water is drawn off and either supplied again to the evaporator through the use of a circulating pump or discarded. The end of evaporation is thus fixed in that separation device during start-up. A start-up system having a separation device of that type and an additionally required separating vessel, valves and a circulating pump, along with the high technical outlay, necessitate high investment costs which increase sharply when the implementation of high and very high steam pressures is desired.

SUMMARY OF THE INVENTION

It is accordingly an object of the invention to provide a method and a system for starting up a continuous-flow steam generator, which overcome the hereinafore-mentioned disadvantages of the heretofore-known methods and devices of this general type, in which start-up losses, especially as a result of a discharge of excess water, are largely avoided in the method and in which that is achieved with simple provisions in the start-up system.

With the foregoing and other objects in view there is provided, in accordance with the invention, a method for starting up a continuous-flow steam generator, which comprises providing a combustion chamber having a number of burners for a fossil fuel; providing the combustion chamber with a gas-tight containment wall formed of at least approximately vertically extending evaporator tubes for conducting a flow of feed-water upwards from below; adjusting a ratio of a fuel stream to a feed-water stream; and adjusting a water level in the evaporator tubes before start-up for completely evaporating the feed water upon passing through the evaporator tubes, so that water is no longer present at an evaporator outlet.

The invention proceeds, in this case, from the consideration that the water level in the evaporator is brought to a specific height before start-up, that is to say before firing of the first burner. On one hand, the water level in the evaporator tubes is to be high enough to guarantee a sufficient cooling of the evaporator tubes. On the other hand, the water level in the evaporator tubes should not be too high, in order to avoid the formation of a water plug occurring downstream of the commencement of the evaporation during the start-up operation. During the start-up operation, that is to say at the moment of firing of the (first) or each burner, the feed water quantity to be supplied per unit time is then to be set in dependence on the fuel quantity supplied to the burners per unit time, with the aim of ensuring that, even without a separation device, no water passes into superheater heating surfaces located downstream in the evaporator on the steam side. Therefore, in accordance with another mode of the invention, the water level in the evaporator tubes is set to a height above the burners.

The level of the water, that is to say the water level in the evaporator tubes, can be derived from the differential pressure established above the evaporator. Consequently, in accordance with a further mode of the invention, the pressure difference, preferably between the evaporator outlet and the evaporator inlet, is determined both in order to determine and in order to set the water level in the evaporator tubes.

With the objects of the invention in view, there is also provided, in a continuous-flow steam generator including a combustion chamber having a number of burners for a fossil fuel and a gas-tight containment wall with at least approximately vertically extending evaporator tubes for conducting a flow of feed-water upwards from below, a start-up system for the continuous-flow steam generator, comprising a setting device for setting a water level in the evaporator tubes before start-up of the continuous-flow steam generator and for setting a ratio of a fuel stream to a feed-water stream upon start-up of the continuous-flow steam generator for completely evaporating the feed water upon passing through the evaporator tubes.

The setting or regulating variable is expediently the evaporator throughput, that is to say the quantity of feed water supplied to the evaporator per unit time on the medium side. Therefore, in accordance with another feature of the invention, the setting device is connected to an actuator and a through-flow-measuring sensor which are connected into a feed-water conduit leading into the evaporator. Furthermore, the setting device is connected to an actuator and a through-flow-measuring sensor which are connected into a fuel conduit leading to the burner or to each burner. Moreover, the setting device is connected to an actuator which, for drainage purposes, is connected into a drain conduit connected to the evaporator on the inlet side. Furthermore, the setting device is connected to a device for determining the water level in the evaporator.

In accordance with a further feature of the invention, there are provided at least two pressure sensors disposed along the evaporator both for determining and for setting the water level in the evaporator.

In accordance with a concomitant feature of the invention, there is provided a connecting conduit between the evaporator outlet and the evaporator inlet, into which a fitting, for example a non-return flap, is connected for the purpose of avoiding a backflow towards the evaporator outlet. Water which is possibly present at the evaporator outlet can be supplied to the evaporator inlet through the connecting conduit when the existing pressure conditions allow. Otherwise, this water can be discharged through a flow-off conduit connected to the connecting conduit.

The advantages achieved through the use of the invention are, in particular, that as early as during start-up, the fresh-steam temperature can be set or regulated to the necessary value solely by adjusting the ratio of the fuel stream to the feed-water stream, since there is no longer any specific evaporation end point. In the case of a start-up system with a separation device, since the end of evaporation is fixed there, the fresh-steam temperature would necessarily have to be set, during startup, so as to conform to the ratio of the evaporator surface to the superheater heating surface, so that it is not possible to regulate the fresh-steam temperature to the necessary value during start-up.

Other features which are considered as characteristic for the invention are set forth in the appended claims.

Although the invention is illustrated and described herein as embodied in a method and a system for starting up a continuous-flow steam generator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The FIGURE of the drawing is a schematic and diagrammatic view of a continuous-flow steam generator with a vertical gas flue and a setting device of a start-up system.

DESCRIPTION OF THE PREFERRED EMBODIMENTS

Referring now in detail to the single figure of the drawing, there is seen a vertical gas flue of a steam generator 1 of rectangular cross-section which is formed by a containment wall 2 that merges at a lower end of the gas flue into a funnel-shaped bottom 3. Evaporator tubes 4 of the containment wall 2 are connected, for example welded, to one another in a gas-tight manner on their longitudinal sides. The bottom 3 includes a diagrammatically illustrated ash discharge orifice 3*a*. A lower region of the containment wall 2 forms a combustion chamber 6 of the continuous-flow steam generator 1. The combustion chamber is provided with a number of burners 5.

A flow on the medium side, that is to say feed water or a water/steam mixture, passes through the evaporator tubes 4 of the containment wall 2 from below upwards in parallel, or in succession in the case of evaporator-tube groups. The evaporator tubes 4 have inlet ends connected to an inlet header 8 and outlet ends connected to an outlet header 10. The inlet header 8 and the outlet header 10 are located outside the gas flue and are each formed, for example, by an annular tube.

The inlet header 8 is connected through a conduit 12 and a header 14 to an outlet of a high-pressure preheater or economizer 15. A heating surface of the economizer 15 is disposed in a space of the containment wall 2. The space is located above the combustion chamber 6. The economizer 15 is connected on the inlet side through a header 16 and a feed-water conduit 18 to a heat exchanger 20, which is heated through the use of steam D and is connected to a delivery side of a feed-water pump 22. A suction side of the feed-water pump 22 is connected through a condenser to a steam turbine in a non-illustrated manner and is thus connected into a water/steam circuit of the latter.

The outlet header 10 is connected through a connecting conduit 24 and a branch conduit 26 to an inlet header 27 of a high-pressure superheater 28 which is disposed within the containment wall 2, between the economizer 15 and the combustion chamber 6. During operation, the high-pressure superheater 28 is connected on the outlet side through a header 30 to a high-pressure part of the steam turbine. An intermediate superheater 32 is provided within the containment wall 2 between the high-pressure superheater 28 and the economizer 15. The intermediate superheater 32 is connected through headers 34, 36 between the high-pressure part and a medium-pressure part of the steam turbine. The economizer 15, the high-pressure superheater 28 and the intermediate superheater 32 are located as convection or platen heating surfaces in a so-called convection flue of the continuous-flow steam generator 1.

The connecting conduit 24 which is routed from the outlet header 10 of the containment wall 2 of the convection flue of the steam generator 1 to the lower inlet header 27 of the high-pressure superheater 28, is routed further vertically to a location that is level with the inlet header 8, that is to say the evaporator inlet. A non-return flap or fitting 40 is inserted into the connecting conduit 24. Drainage conduits 42, 44, into which drainage valves or actuators 46 and 48 are inserted, are connected to the connecting conduit 24 on both sides of the non-return flap 40.

A first valve or actuator 50 and a first throughflow-measuring sensor 52 are inserted into the feed-water conduit 18 downstream of the heat exchanger 20, in the direction of flow of feed water S. The throughflow-measuring sensor 52 serves for determining a quantity of feed water S that is guided per unit time through the feed-water conduit 18 and consequently serves for determining the feed-water stream or flow. The quantity of feed water S which is guided per unit time through the feed-water conduit 18 corresponds to the feed-water quantity supplied to the evaporator, including the evaporator tubes 4, and consequently it corresponds to the evaporator throughput.

A second throughflow-measuring sensor 54 is connected into a fuel conduit 56 which opens through part conduits 58 into the burners 5. Inserted into the fuel conduit 56 is a second valve or actuator 60 for setting a quantity of fuel B supplied per unit time to the burner or each burner 5 and consequently for setting the fuel stream or flow. Oil, gas or coal can be used as the fuel B.

The throughflow-measuring sensors 52 and 54 are connected through signal lines 62 and 64 to a controller module 66 as a setting device. A further signal line 68 which is connected to the controller module 66 is also connected through measuring lines 70 and 72 to pressure sensors 74 and 76 which are respectively provided for measuring a pressure $p_E$ at the evaporator inlet and the pressure $p_A$ at the evaporator outlet. Therefore, elements 68, 70, 72, 74, 76 form a device for determining the water level H in the evaporator tubes 4. Moreover, the controller module 66 is connected through control lines 78, 80 and 82 to the valves 50, 60 and 48. The controller module 66 and the throughflow-measuring sensors 52, 54 as well as the valves 50 and 60 which respectively serve for setting the quantity of feed water S and for setting the quantity of fuel B are components of a start-up system 84 for starting up the continuous-flow steam generator 1. Further components of the start-up system 84 are the pressure sensors 74, 76 connected through the signal line 68 to the controller module 66, as well as the valve 48 connected through the control line 82 to the controller module 66 for drainage from the lower evaporator part.

The start-up system 84 serves for setting the ratio of the fuel stream to the feed-water stream, with the aim of ensuring that the feed water S evaporates completely during passage through the evaporator tubes 4, so that water is no longer present at the evaporator outlet, that is to say at the outlet header 10. In this case, before start-up, a water level H in the evaporator tubes 4 is brought to a specific height $H_{min}$ in the evaporator which is just above the burners 5. This is carried out, for example, by a further feed of the feed water S through the use of the feed-water pump 22 or by drainage from the lower evaporator part through the drainage conduit 44. The water level H in the evaporator tubes 4, that is to say the water height, is set through the use of a measurement of differential pressure across the evaporator. For this purpose, a differential pressure $\Delta_{pA,E}$, which is obtained from a difference between the pressures $p_A$ and $p_E$ respectively measured through the use of the pressure sensors 74 and 76 at the evaporator outlet and at the evaporator inlet, is supplied as a measured value to the controller module 66 through the signal line 68.

The water level H in the evaporator tubes 4 is kept between two limit values $H_{max}$ and $H_{min}$, in which case:

$$H_{\min} = H_{SB} + L \cdot \sqrt{P_S} \cdot F \text{ and}$$

$$H_{\max} = H_{KHF} - T_{\min} \cdot v_{WS} \text{ wherein:}$$

$H_{SB}$ is the height (top edge) of the highest burner which is in operation with the starting firing capacity;

L is a flame length L when the burner is under full load;

$P_s$ is the relative starting firing capacity of the burner;

F is an adaptive factor which was determined empirically at approximately 0.5 to 2;

$H_{KHF}$ is a height at which the convection or platen heating surfaces start with a close spacing (<400 mm);

T is a time (3 to 10 minutes) for filling a storage vessel, that is to say the evaporator tubes, up to the water level H at a velocity $v_{W,S}$; and $v_{WS}$ is a water velocity in the evaporator tubes at the start of the feed-water stream at the moment of ignition of the first burner.

In order to set the ratio of the fuel stream to the feed-water stream, the current value, measured through the use of the throughflow-measuring sensor 52, of the feed water S supplied per unit time to the evaporator, that is to say the evaporator tubes 4, is transmitted to the controller module 66 through the signal line 62. This value supplied to the controller module 66 by the throughflow-measuring sensor 52 corresponds to the current feed-water stream and consequently to the evaporator throughput. Moreover, the value, measured at the current moment through the use of the throughflow-measuring sensor 54, of the quantity of fuel B supplied to the burners 5, is transmitted to the controller module 66 through the signal line 64. At the same time, the height, that is to say the water level H, at a moment "fire ON" and the ratio of the fuel stream to the feed-water stream are selected in such a way that pure steam is present at the outlet header 10, so that no water flows into the superheater heating surface 28.

The branch conduit 26 from the connecting conduit 24 is disposed at the inlet height of the superheater heating surface 28. Water which is possibly present in the outlet header 10 will consequently flow past this branch to the superheater heating surface 28 and collect in the lower part of the vertical connecting conduit 24. From there, this water can be either discharged through the drainage valve 46 or supplied to the inlet header 8 of the evaporator. Alternatively, the water that is possibly present can also be supplied to the conduit 12 between the economizer 15 and the inlet header 8 of the evaporator. In this case, a backflow to the outlet header 10 is prevented by the non-return flap 40.

We claim:

1. A method for starting up a continuous-flow steam generator, which comprises:

providing a combustion chamber having a number of burners for a fossil fuel;

providing the combustion chamber with a gas-tight containment wall formed of at least approximately vertically extending evaporator tubes for conducting a flow of feed-water upwards from below;

adjusting a ratio of a fuel stream to a feed-water stream; and adjusting a water level in the evaporator tubes before start-up for completely evaporating the feed water upon passing through the evaporator tubes.

2. The method according to claim 1, which comprises setting the water level in the evaporator tubes to a height above the burners.

3. The method according to claim 1, which comprises determining a pressure difference along the evaporator tubes for setting the water level in the evaporator tubes.

4. In a continuous-flow steam generator including a combustion chamber having a number of burners for a fossil fuel and a gas-tight containment wall with at least approximately vertically extending evaporator tubes for conducting a flow of feed-water upwards from below, a start-up system for the continuous-flow steam generator, comprising:

a setting device for setting a water level in the evaporator tubes before start-up of the continuous-flow steam generator and for setting a ratio of a fuel stream to a feed-water stream upon start-up of the continuous-flow steam generator for completely evaporating the feed water upon passing through the evaporator tubes.

5. The start-up system according to claim 4, including:

a feed-water conduit leading into the evaporator tubes;

a first actuator and a first throughflow-measuring sensor connected to said setting device and connected into said feed-water conduit;

a fuel conduit leading to at least one of said burners;

a second actuator and a second throughflow-measuring sensor connected to said setting device and connected into said fuel conduit;

a drain conduit connected to an inlet side of the evaporator tubes;

a third actuator connected to said setting device and connected into said drain conduit; and a device connected to said setting device for determining the water level in the evaporator tubes.

6. The start-up system according to claim 5, wherein said device for determining the water level in the evaporator tubes includes at least two pressure sensors disposed along the evaporator tubes.

7. The start-up system according to claim 4, including an evaporator outlet and an evaporator inlet connected to said evaporator tubes, a connecting conduit between said evaporator outlet and said evaporator inlet, a fitting connected into said connecting conduit for avoiding a backflow towards said evaporator outlet, and a flow-off conduit connected to said connecting conduit.

* * * * *